US011589646B1

(12) United States Patent
Weschler

(10) Patent No.: US 11,589,646 B1
(45) Date of Patent: Feb. 28, 2023

(54) FOOTWEAR SOLE WITH PIVOT POINT

(71) Applicant: FUEGO, INC., Miami Beach, FL (US)

(72) Inventor: Kevin Weschler, Miami, FL (US)

(73) Assignee: FUEGO, INC., Miami Beach, FL (US)

( * ) Notice: Subject to any disclaimer, the term of this patent is extended or adjusted under 35 U.S.C. 154(b) by 0 days.

(21) Appl. No.: 17/688,381

(22) Filed: Mar. 7, 2022

(51) Int. Cl.

| | |
|---|---|
| ***A43B 7/14*** | (2022.01) |
| ***A43B 13/22*** | (2006.01) |
| ***A43B 13/14*** | (2006.01) |
| ***A43B 13/18*** | (2006.01) |

(52) U.S. Cl.
CPC ..... *A43B 13/145* (2013.01); *A43B 13/187* (2013.01); *A43B 13/223* (2013.01)

(58) Field of Classification Search
None
See application file for complete search history.

(56) References Cited

U.S. PATENT DOCUMENTS

| | | | | | |
|---|---|---|---|---|---|
| D201,952 | S * | 8/1965 | Johns | A43C 15/168 | D2/956 |
| 4,653,206 | A * | 3/1987 | Tanel | A43B 3/0042 | 36/134 |
| 4,893,418 | A * | 1/1990 | Ogden | A43B 17/00 | 36/154 |
| 4,925,724 | A * | 5/1990 | Ogden | A43B 17/00 | 428/137 |
| 5,313,718 | A * | 5/1994 | McMahon | A43B 3/0042 | 36/31 |
| 6,035,559 | A * | 3/2000 | Freed | A43C 15/168 | 36/134 |
| 6,516,540 | B2 * | 2/2003 | Seydel | A43B 13/189 | 36/25 R |
| 8,424,221 | B2 * | 4/2013 | Litchfield | A43B 21/265 | 36/35 B |
| 8,844,170 | B2 * | 9/2014 | Ferrigan | A43B 13/181 | 36/102 |
| 9,107,470 | B2 | 8/2015 | Fallow et al. | | |
| 10,212,988 | B2 * | 2/2019 | Youngs | A43B 13/188 | |
| D923,307 | S | 6/2021 | Weschler | | |
| 2005/0257402 | A1 * | 11/2005 | Kobayashi | A43B 5/10 | 36/59 R |
| 2007/0107260 | A1 * | 5/2007 | Pasternak | A43B 21/38 | 36/39 |

* cited by examiner

*Primary Examiner* — Jila M Mohandesi
(74) *Attorney, Agent, or Firm* — Myers Wolin, LLC

(57) ABSTRACT

A footwear sole structure is provided herein comprising a sole including a heel portion and a forefoot portion and at least one pivot point. Each pivot point is disposed on one of the heel portion and the forefoot portion, and is smaller, in coefficient of friction, than the sole.

16 Claims, 6 Drawing Sheets

FOOTWEAR SOLE WITH PIVOT POINT

FIELD

The present disclosure generally relates to a footwear sole with a pivot point.

BACKGROUND

Footwear, such as shoes, designed for dancing, have been proposed. This includes footwear configured for pivoting. Such footwear typically includes a pivot point disposed on a ball portion of a foot.

However, the inventor has recognized that such existing footwear is not functional for a variety of reasons. For example, soles of such footwear may be designed for use on a dance floor, and may be too delicate for use on the street. Further, pivot points integrated into such soles may not be functional if they are flush with the sole. Further, where shoes are designed for use on the street, the sole material, including the tread and the pivot point, may generate too much grip for effective use of the pivot point. Therefore, the inventor has recognized that there is a need to solve at least one of these problems.

The description provided in the background section should not be assumed to be prior art merely because it is mentioned in or associated with the background section. The background section may include information that describes one or more aspects of the subject technology.

SUMMARY

A footwear sole structure is provided herein comprising a sole including a heel portion and a forefoot portion and at least one pivot point. Each pivot point is disposed on one of the heel portion and the forefoot portion, and is smaller, in coefficient of friction, than the sole.

In some embodiments, the sole includes a bottom surface, and each pivot point of the at least one pivot point protrudes from the bottom surface of the sole such the pivot point is proud of the sole. In some such embodiments, at least one pivot point protrudes from the bottom surface of the sole by less than 0.5 mm.

In some embodiments, one pivot point of the at least one pivot point includes a first bottom surface and a first recess that is recessed from the first bottom surface. The first recess may then overlap with a center of the one pivot point in a bottom view. In some such embodiments, the first bottom surface may surround the first recess in the bottom view.

In some embodiments having a first recess, the first recess may include an inner surface which may be curved in a concave shape.

In some embodiments having a first recess, the one pivot point may include a second bottom surface and a second recess, such that the second recess is disposed between and is recessed from the first bottom surface and the second bottom surface. The second recess may surround the first bottom surface and the first recess in the bottom view. The second bottom surface may then surround the first bottom surface, the first recess, and the second recess in the bottom view.

In some such embodiments, the second recess has a ring shape, and the first recess has a dimension greater than a width of the ring shape of the second recess.

In some embodiments, the pivot point is bounded by a recessed boundary, the recessed boundary separating the corresponding pivot point from the sole.

In some such embodiments, the recessed boundary is greater in depth relative to the first bottom surface than the first or second recess. In some such embodiments, each pivot point protrudes from a bottom surface of the sole, and the recessed boundary is recessed relative to the bottom surface of the sole by approximately the same depth as the first recess or the second recess are recessed relative to the first bottom surface.

In some embodiments, at least one pivot point and the sole comprise different materials. In some such embodiments, each pivot point is greater in hardness than the sole.

In some embodiments, the at least one pivot point includes a first pivot point and a second pivot point, where the first pivot point is disposed on the heel portion and the second pivot point is disposed on the forefoot portion. In some such embodiments, the first pivot point is configured to be located under a heel of the foot of a user when worn and the second pivot point is configured to be located under a ball of a foot of the user.

In some embodiments, the footwear sole is integrated into an item of footwear, such as a shoe, the item of footwear having the sole structure and a footwear upper disposed on the shoe sole structure. In some such embodiments, the foot wear upper comprises a different material than either the sole or the pivot point.

In some embodiments, the heel portion and the forefoot portion are discrete sole components and are connected to each other only by way of the footwear upper.

In some such embodiments, a contiguous pattern may extend from the heel portion to the forefoot portion and is integrated into a tread of the sole. No portion of the contiguous pattern may then be presented on a segment of the footwear upper connecting the heel portion to the forefoot portion.

In some embodiments, the heel portion and the forefoot portion are integrated into a contiguous sole fixed to the footwear upper.

DRAWINGS

EMBODIMENTS

Figure 1:
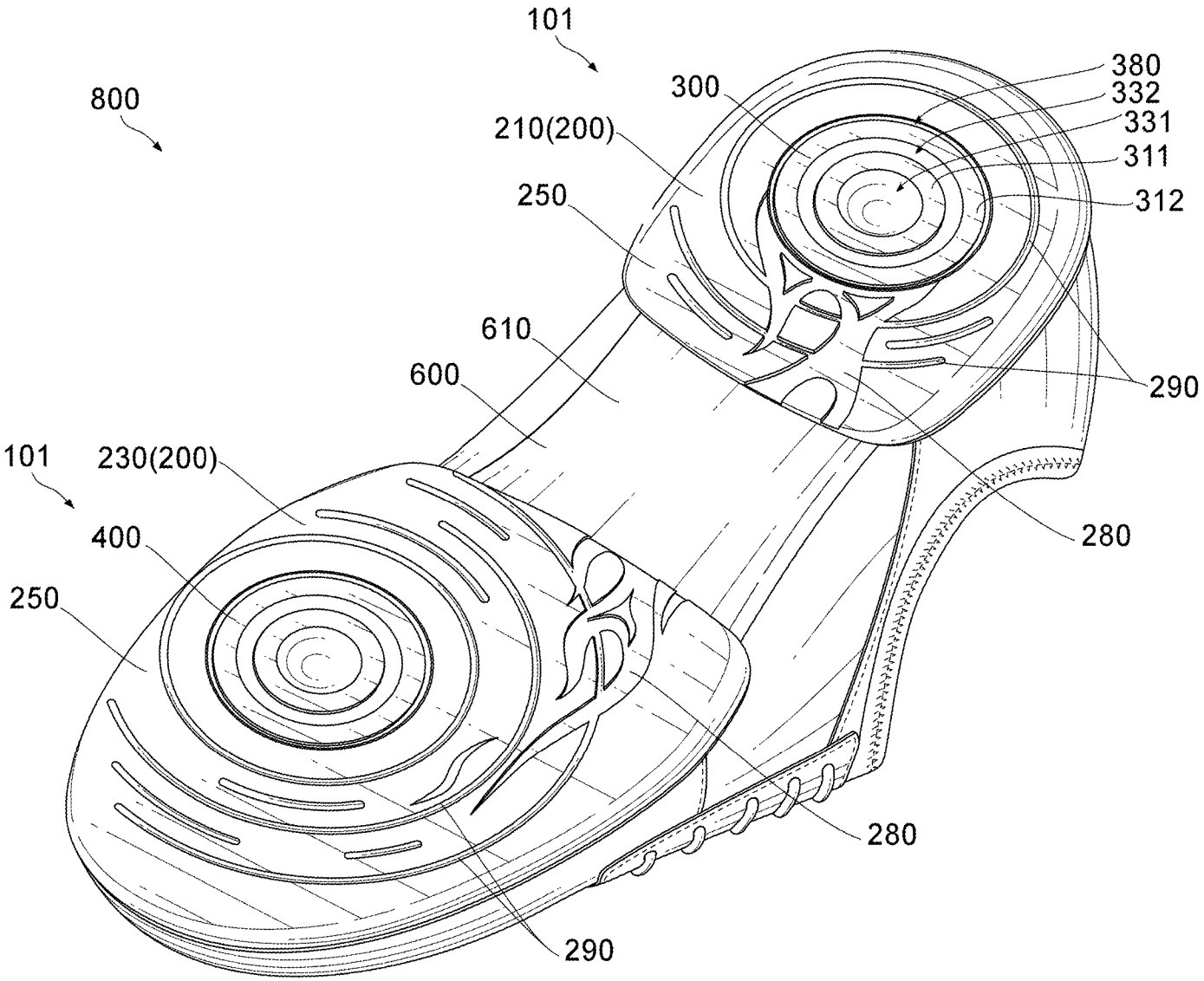
FIG. 1 is a perspective view of an item of footwear according to some embodiments.

The description of illustrative embodiments according to principles of the present disclosure is intended to be read in connection with the accompanying drawings, which are to be considered part of the entire written description. In the description of embodiments of the disclosure disclosed herein, any reference to direction or orientation is merely intended for convenience of description and is not intended in any way to limit the scope of the present disclosure. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the disclosure are illustrated by reference to the exemplified embodiments. Accordingly, the disclosure expressly should not be limited to such exemplary embodiments illustrating some possible non-limiting combination of features that may exist alone or in other combinations of features; the scope of the disclosure being defined by the claims appended hereto.

This disclosure describes the best mode or modes of practicing the disclosure as presently contemplated. This description is not intended to be understood in a limiting sense, but provides an example of the disclosure presented solely for illustrative purposes by reference to the accompanying drawings to advise one of ordinary skill in the art of the advantages and construction of the disclosure. In the various views of the drawings, like reference characters designate like or similar parts.

It is important to note that the embodiments disclosed are only examples of the many advantageous uses of the innovative teachings herein. In general, statements made in the specification of the present application do not necessarily limit any of the various claimed disclosures. Moreover, some statements may apply to some inventive features but not to others. In general, unless otherwise indicated, singular elements may be in plural and vice versa with no loss of generality.

Some embodiments of the present disclosure can provide a footwear sole that includes at least one pivot point. The pivot point may be, but is not limited to, a circular section on the bottom of the footwear sole of a footwear. The pivot point may include or comprise a contrasting material having a lower coefficient of friction which provides for less friction and easier spinning ability for a dancer. The density and/or hardness of the pivot point may be carefully calculated in order to provide the right level of friction relative to the rest of the sole. The pivot point may protrude from the sole, for example, by 0.5 mm so that the pivot point can be easier to access. The pivot point may be located under the ball of the foot of the user or the heel of the user, areas which a lot of pressure is placed by the foot.

One embodiment of the pivot point is configured to allow a user to dance, spin, and/or turn by pivoting while wearing footwear (e.g., shoes or sneakers) comprising the pivot point. One embodiment of the footwear can be suitable for both dance floor and street wear. In some examples, the pivot points make footwear (e.g., sneakers) more versatile for dancing. The present disclosure can provide footwear (e.g., sneakers) that does not have to be formal (aesthetically), and/or that is convenient than a traditional dance shoe. One embodiment of the footwear according to the present disclosure may provide a functional footwear that comprises a contrasting material that is embedded into the rest of the sole and proud of the sole.

Figure 2:
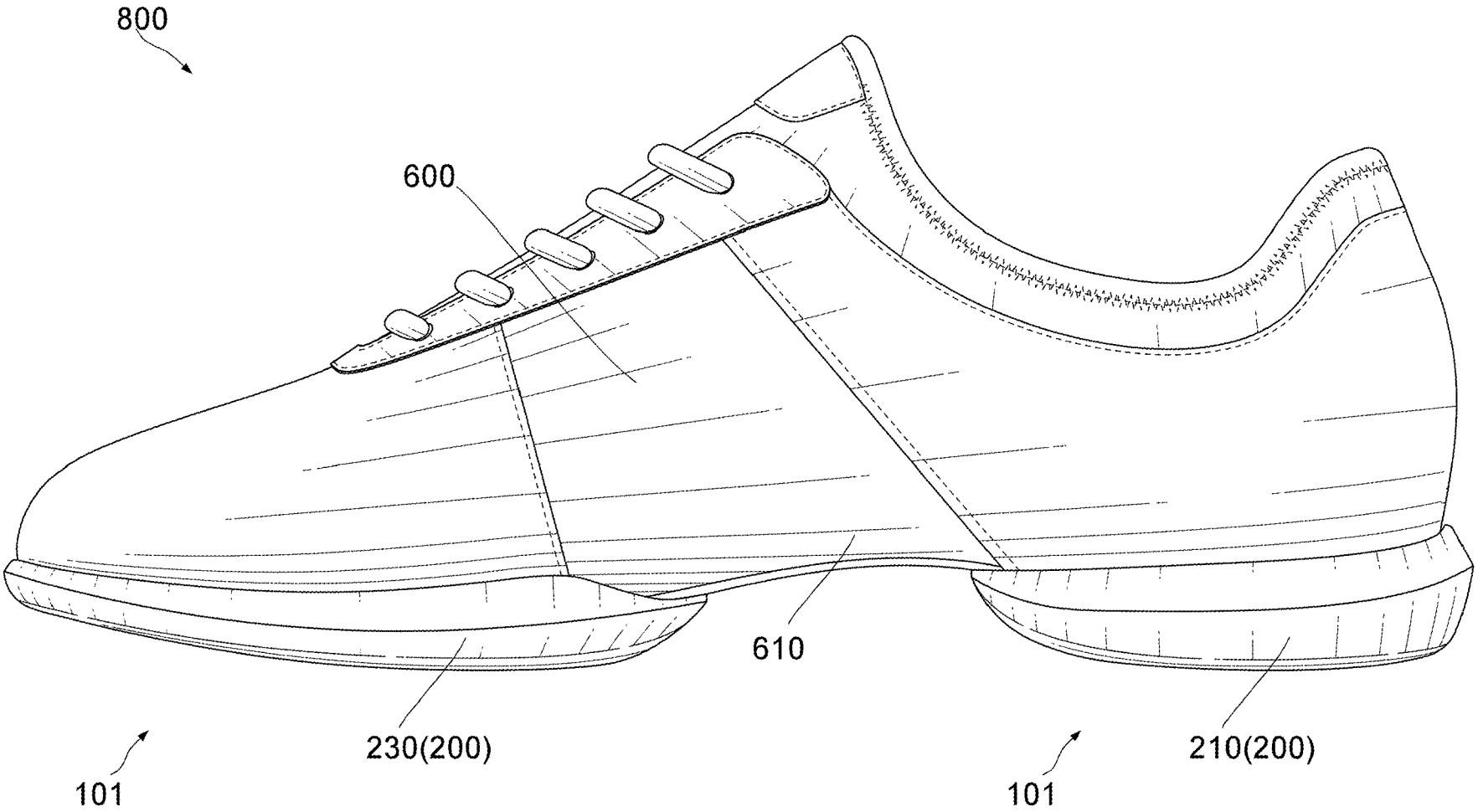
FIG. 2 is a side view of a footwear sole structure according to some embodiments.
Figure 3:
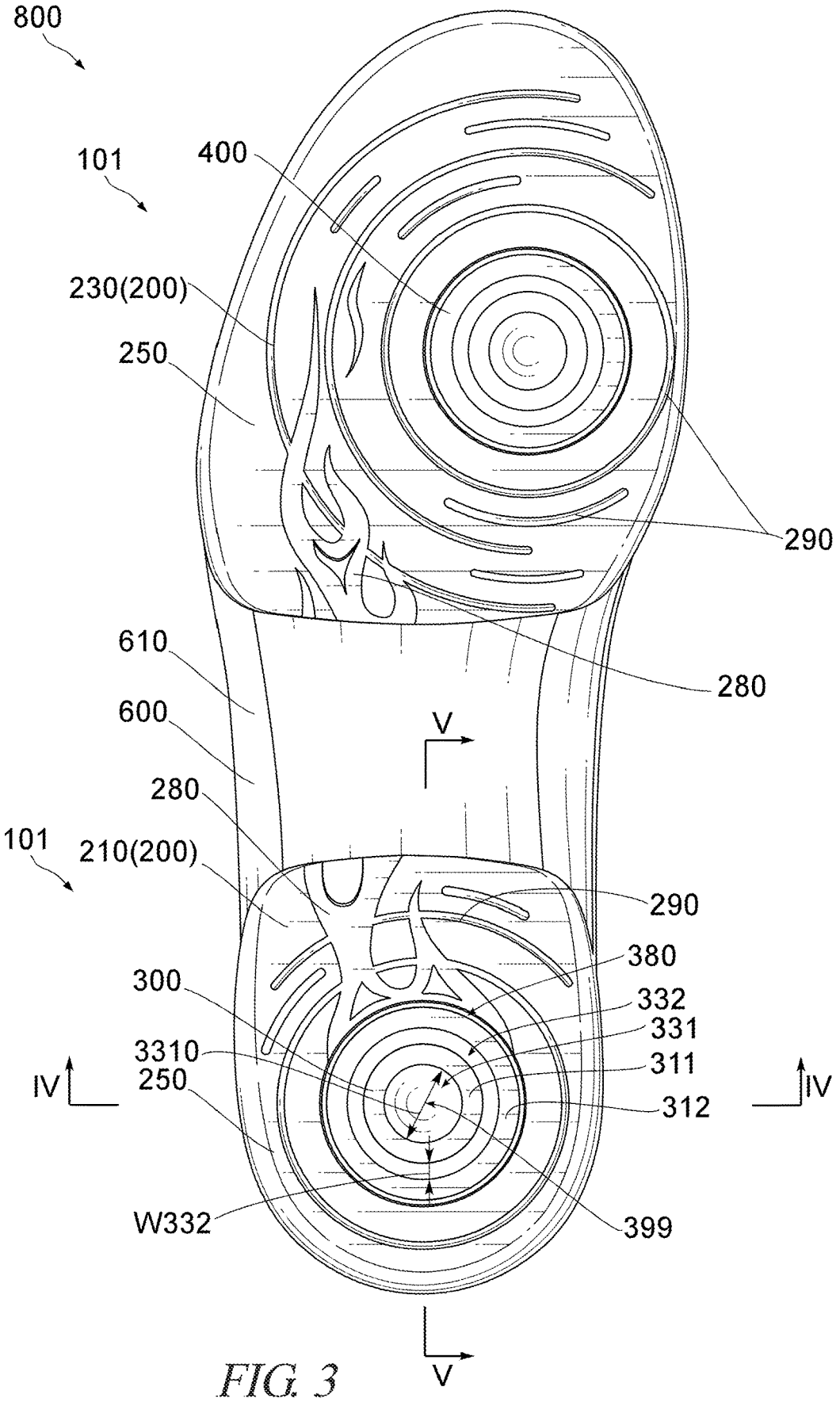
FIG. 3 is a bottom view of a footwear sole structure according to some embodiments.

FIG. 1 is a perspective view of an item of footwear, in this case a sneaker, according to some embodiments. FIG. 2 is a side view of a footwear sole structure according to some embodiments. FIG. 3 is a bottom view of a footwear sole structure according to some embodiments.

Footwear 800 shown in FIGS. 1-3 may include a footwear sole structure 101 and a footwear upper 600 disposed on the shoe sole structure 101. The footwear sole structure 101 may include a sole 200, a pivot point 300 (e.g., a first pivot point), and a pivot point 400 (e.g., a second pivot point). The sole 200 may include a heel portion 210 and a forefoot portion 230. In some embodiments, such as that shown in FIGS. 1-3, the heel portion 210 and the forefoot portion 230 may be discrete and be connected to each other only by way of the footwear upper 600. In some alternative embodiments, such as that shown in FIG. 6, the heel portion and forefoot portion may be integrated into a single contiguous sole. The footwear upper 600 may include a segment 610 connecting the heel portion 210 to the forefoot portion 230.

Figure 6:
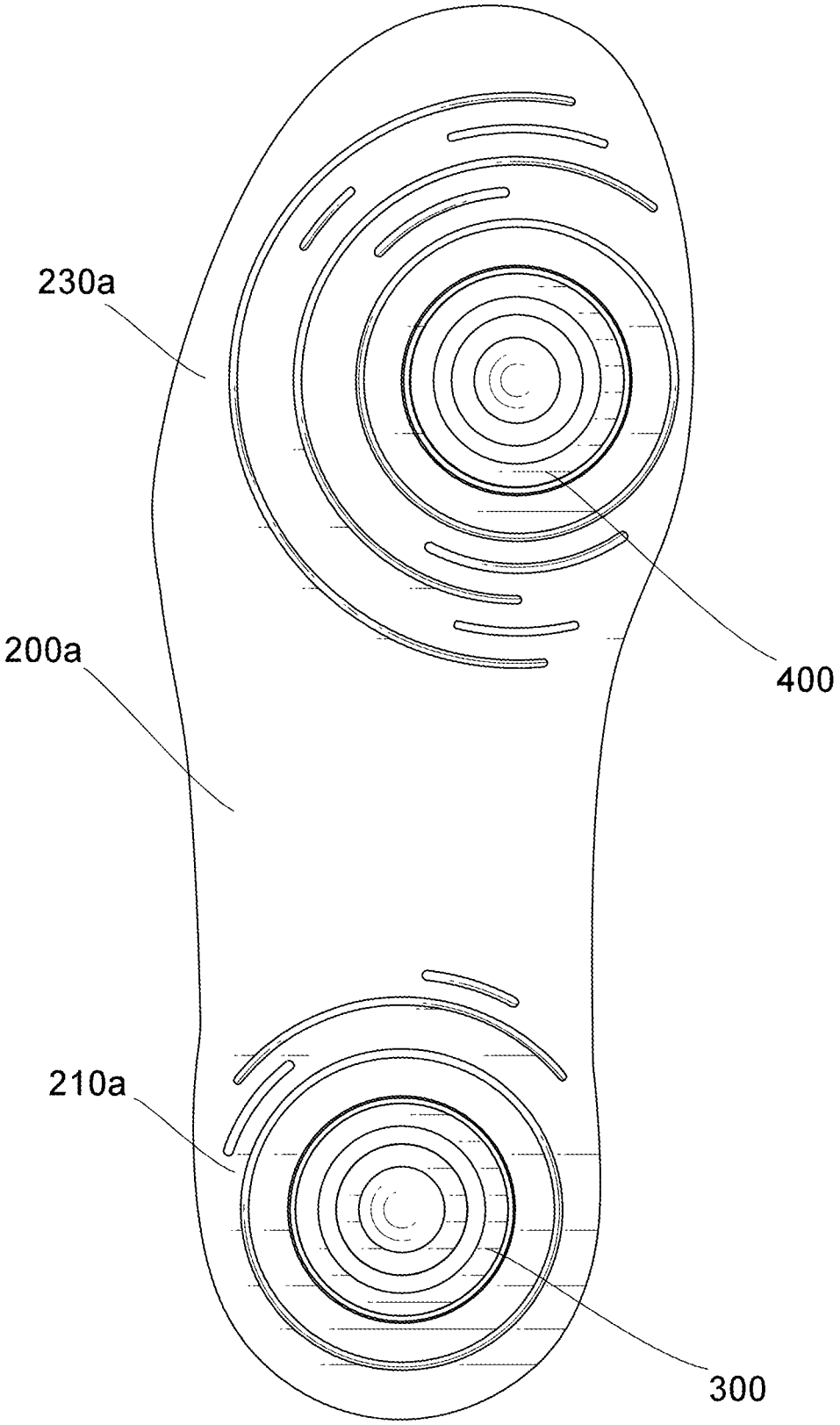
FIG. 6 is a bottom view of a footwear sole according to a second embodiment.

As shown in FIGS. 1 and 3, the sole 200 includes a bottom surface 250. As shown in the illustrated example, a tread 290 and a contiguous pattern 280 may be formed on the bottom surface 250 of the sole 200. In some embodiments, the contiguous pattern 280 may extend from the heel portion 210 to the forefoot portion 230, and may be integrated into the tread 290 of the sole 200. In some embodiments, no portion of the contiguous pattern 280 is presented on the segment 610 connecting the heel portion 210 to the forefoot portion 230. In other embodiments, as shown in FIG. 6, a heel portion 210*a* and a forefoot portion 230*a* may be integrated into a contiguous sole 200*a* fixed to the footwear upper 600.

With reference to FIGS. 1 and 3, the pivot point 300 may be disposed on the heel portion 210. The pivot point 300 may be configured to be located under the heel of the foot of the user. The pivot point 400 may be disposed on the forefoot portion 230. The pivot point 400 may be configured to be located under the ball of the foot of a user. In some embodiments, an additional pivot point may be disposed on the sole 200, and in other embodiments, only the pivot point 300 or only the pivot point 400 is disposed on the sole 200. In the illustrated example, the pivot points 300 and 400 may have the same or similar configurations. Therefore, the following explanations as for the pivot point 300 may be applied to the pivot point 400.

Figure 4:
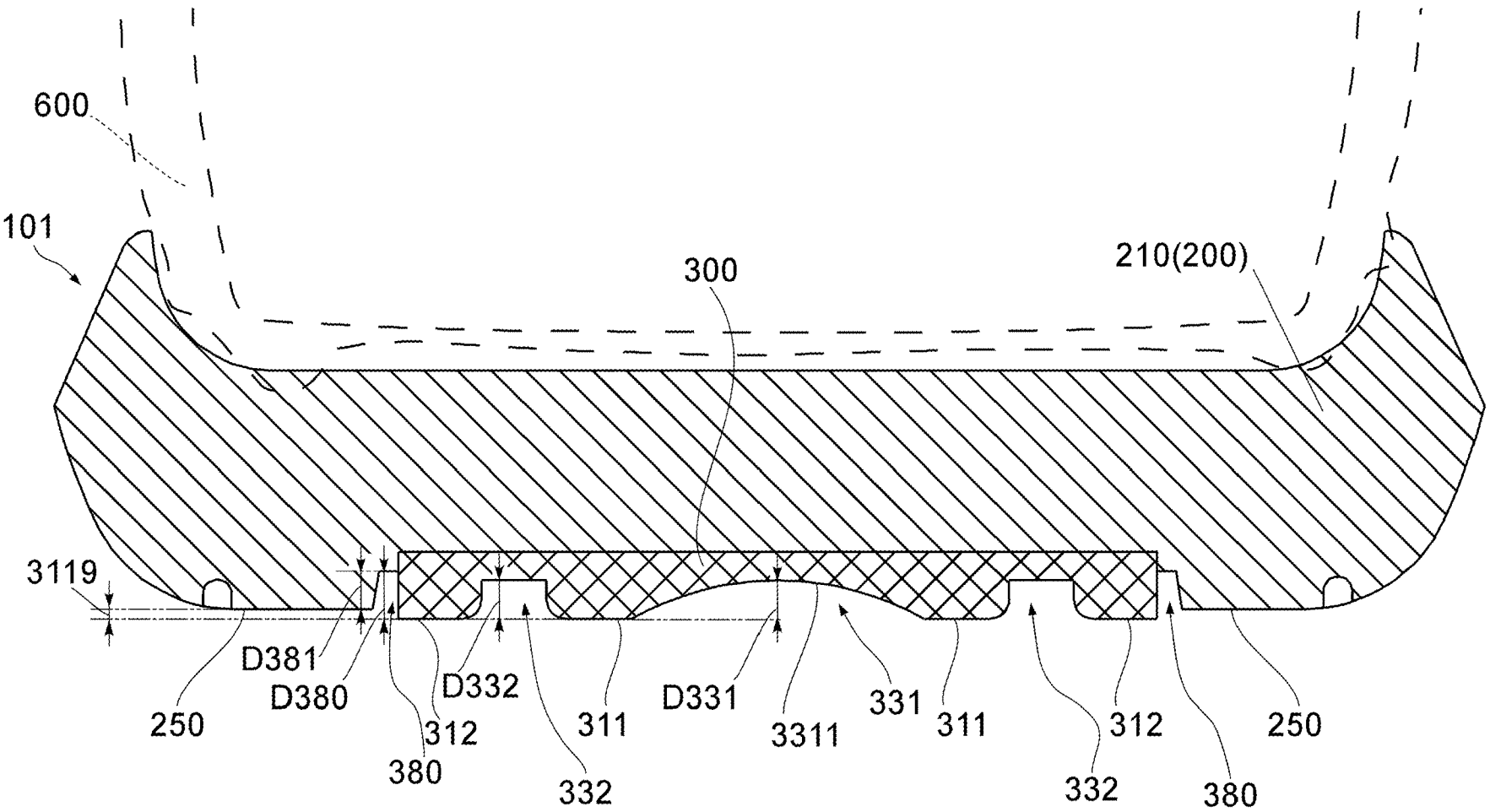
FIG. 4 is a cross-sectional view taken along line IV-IV in FIG. 3.
Figure 5:
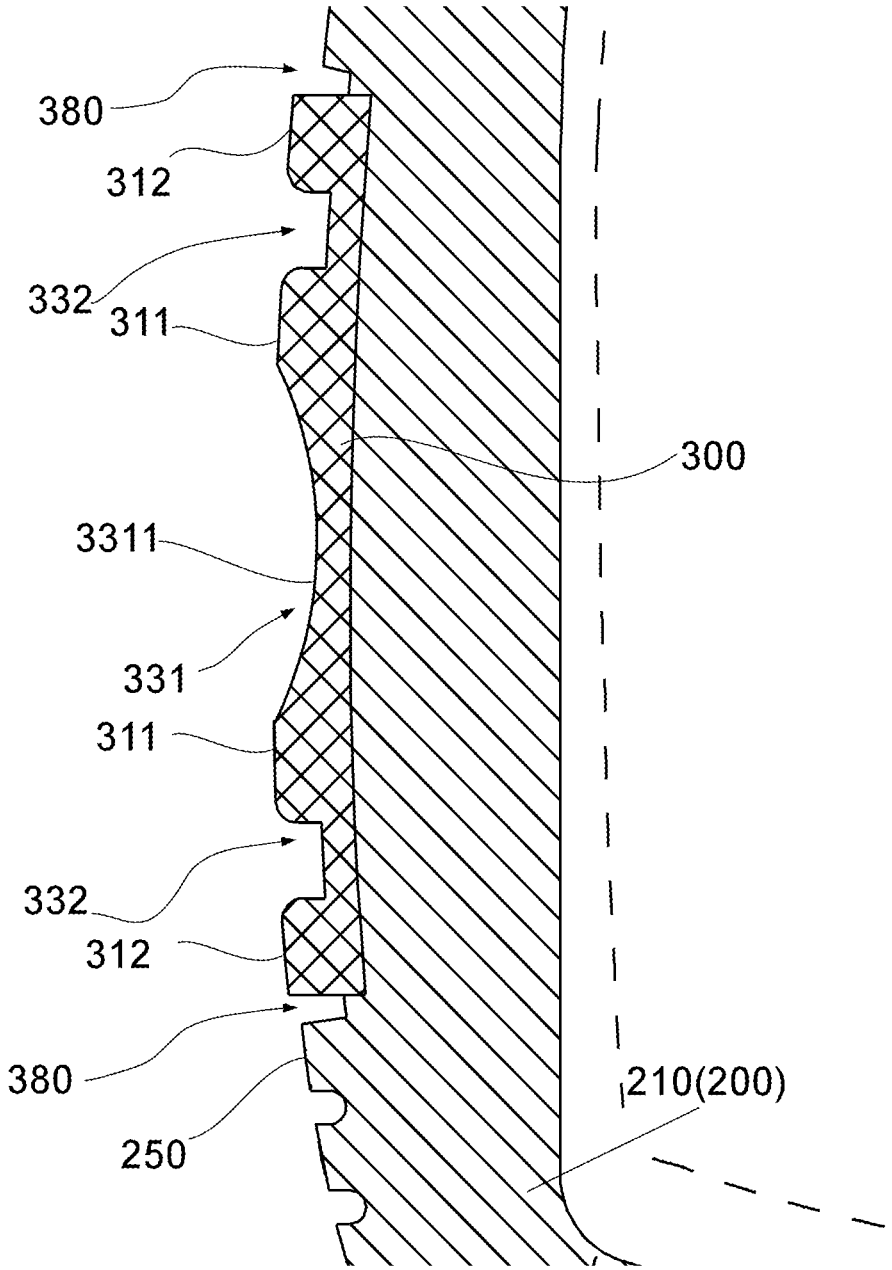
FIG. 5 is a cross-sectional view taken along line V-V in FIG. 3.

FIG. 4 is a cross-sectional view taken along line IV-IV in FIG. 3. FIG. 5 is a cross-sectional view taken along line V-V in FIG. 3.

With reference to FIGS. 3-5, in some embodiments, the pivot point 300 may have a circular outline shape in the bottom view. However, the shape of the pivot point 300 is not limited to this shape and may be any other shape such as triangle, rectangle, polygon, and oval. In some embodiments, the pivot point 300 may be smaller, in coefficient of friction, than the sole 200. In the present disclosure, the coefficient of friction of an object, namely the pivot point 300 or the sole 200, means a coefficient of friction of the object relative to the same material. It will be understood that this relates to a comparison between the material of the pivot point 300 and the material of the sole 200, and that, for comparison purpose, the coefficient of static and/or kinetic friction between the pivot point and a wood dance floor or an asphalt street is lower than the corresponding coefficient of friction between the sole and the same wood dance floor or asphalt street. It is further understood that this comparison may not hold across all potential materials that the pivot point 300 and sole may come in contact with.

In some embodiments, each of the pivot points 300 may be greater in hardness than the sole 200. In the present disclosure, the hardness of an object means the ASKER-B hardness of the object. The pivot point 300 may comprise a different material than the sole 200. In addition, the footwear upper 600 may comprise a different material than either the pivot point 300 or the sole 200. For example, upper 600 may comprise a microfiber, leather, or vegan leather material, pivot point 300 may comprise a thermoplastic polymer such as thermoplastic polyurethane (TPU), and sole 200 may comprise a non-thermoplastic polyurethane (PUR). It is understood that while density is not necessarily proportional to hardness, the pivot points may separately be greater in density than the sole.

As shown in FIG. 4, in some embodiments, the pivot point 300 may protrude from the bottom surface 250 of the sole 200 by a difference 3119. The difference 3119 may be, but is not limited to, less than 0.5 mm. Referring to FIGS. 3 and 4, the pivot point 300 may include a first bottom surface 311 and a second bottom surface 312. In some embodiments, the first bottom surface 311 may be surrounded by the second bottom surface 312 in the bottom view. In some examples, each of the first bottom surface 311 and the second bottom surface 312 has a ring shape. However, the shape of the first bottom surface 311 and the second bottom surface 312 is not limited to a ring shape and may be any other shape.

With reference to FIGS. 3 and 4, the pivot point 300 may be provided with a first recess 331. The first recess 331 may be recessed from the first bottom surface 311. As shown in FIG. 3, the first recess 331 may overlap with a center 399 of the pivot point 300 in the bottom view. The first recess 331 may be surrounded by the first bottom surface 311 in the bottom view. As shown in FIG. 4, the first recess 331 includes an inner surface 3311. In some embodiments, the inner surface 3311 may be curved in a concave shape. In other embodiments, the inner surface 3311 may be formed by a plurality of flat surfaces. The first recess 331 may have a circular shape in the bottom view, but the shape of the inner surface 3311 is not limited to this and may be any other shape, such as triangle, rectangle, polygon, and oval.

With reference to FIGS. 3-4, the pivot point 300 may be further provided with a second recess 332. In the illustrated example, the second recess 332 may disposed between and may be recessed from the first bottom surface 311 and the second bottom surface 312. The second recess 332 may surround the first bottom surface 311 and the first recess 331 in the bottom view. The second recess 332, the first recess 331, and the first bottom surface 311 may be surrounded by the second bottom surface 312 in the bottom view. In some embodiments, the second recess 332 has a ring shape, and the first recess 331 may have a dimension 3310 (e.g., the diameter of the first recess 331 in the example of FIG. 3) greater than a width W332 of the ring shape of the second recess 332. In some embodiments, the second recess 332 may be approximately the same in depth relative to the first bottom surface 311 as the first recess 331. For example, as shown in FIG. 4, a depth D332 of the second recess 332 relative to the first bottom surface 311 may be approximately the same as a depth D331 of the first recess 331 relative to the first bottom surface 311. The relationship between the depth D332 and the depth 331 is not limited to this example.

With reference to FIGS. 3 and 4, in some embodiments, the pivot point 300 may be bounded by a recessed boundary 380. The recessed boundary 380 may separate the corresponding pivot point 300 from the sole 200. As shown in FIG. 4, in some embodiments, the recessed boundary 380 may be greater in depth relative to the first bottom surface 311 than the first or second recess 332. For example, a depth D380 of the recessed boundary 380 relative to the first bottom surface 311 may be greater than the depth D331 of the first recess 331 or the depth D332 of the second recess 332. In some embodiments, the recessed boundary 380 may be recessed relative to the bottom surface 250 of the sole 200 by approximately the same depth as the first recess 331 or the second recess 332 is recessed relative to the first bottom surface 311. For example, a depth D381 of the recessed boundary 380 relative to the bottom surface 250 may be approximately the same as the depth D331 of the first recess 331 or the depth D332 of the second recess 332. However, the relationship among the depth D380, the depth D332 and the depth D331 and the relationship among the depth D381, the depth D332 and the depth D331 are not limited to these examples.

According to the present disclosure, a pivot point (e.g., the pivot points 300 and 400) may be provided. In some embodiments, the pivot point is smaller, in coefficient of friction, than a sole. Thus, the pivot point can provide less friction and thus provide easier spinning ability of a user wearing the footwear described herein. Therefore, the user can more easily dance, spin, and/or turn. In some embodiments, the pivot point protrudes from the bottom surface of the sole. This allows the pivot point to more reliably come into contact with a floor or the ground. Therefore, the user can more easily dance, spin, and/or turn. In some embodiments, the pivot point is greater in hardness than the sole. Thus, excessive wear of the pivot point relative to the sole can be suppressed despite the protrusion of the pivot point relative to the rest of the sole.

While the present disclosure has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the disclosure.

All examples and conditional language recited herein are intended for pedagogical purposes to aid the reader in understanding the principles of the disclosure and the concepts contributed by the inventor to furthering the art, and are to be construed as being without limitation to such specifically recited examples and conditions. Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

What is claimed is:

1. Footwear, comprising:

a footwear sole structure comprising:

a sole including a heal portion and a forefoot portion; and at least one pivot point, each pivot point of the at least one pivot point being disposed on one of the heal portion and the forefoot portion, each pivot point of the at least one pivot point being smaller, in coefficient of friction, than the sole, and a footwear upper disposed on the shoe sole structure, wherein the heel portion and the forefoot portion are discrete and are connected to each other only by way of the footwear upper, and wherein a contiguous pattern extending from the heel portion to the forefoot portion is integrated into a tread of the sole, and wherein no portion of the contiguous pattern is presented on a segment of the footwear upper connecting the heel portion to the forefoot portion.

2. The footwear of claim 1, wherein one pivot point of the at least one pivot point includes a first bottom surface and is provided with a first recess that is recessed from the first bottom surface, and wherein the first recess overlaps with a center of the one pivot point of the at least one pivot point in a bottom view.

3. The footwear of claim 1, wherein the first bottom surface surrounds the first recess in the bottom view.

4. The footwear of claim 2, wherein the first recess includes an inner surface, and the inner surface being curved in concave shape.

5. The footwear of claim 2, wherein the one pivot point of the at least one pivot point includes a second bottom surface, and the one pivot point of the at least one pivot point is provided with a second recess, the second recess is disposed between and is recessed from the first bottom surface and the second bottom surface, and the second recess surrounds the first bottom surface and the first recess in the bottom view, and the second bottom surface surrounds the first bottom surface, the first recess, and the second recess in the bottom view.

6. The footwear of claim 5, wherein the second recess has a ring shape, and the first recess has a dimension greater than a width of the ring shape of the second recess.

7. The footwear of claim 5, wherein each pivot point of the at least one pivot point is bounded by a recessed boundary, the recessed boundary separating the corresponding pivot point from the sole.

8. The footwear of claim 7, wherein the recessed boundary is greater in depth relative to the first bottom surface than the first or second recess.

9. The footwear of claim 8, wherein each pivot point protrudes from a bottom surface of the sole, and wherein the recessed boundary is recessed relative to the bottom surface of the sole by approximately the same depth as the first recess or the second recess is recessed relative to the first bottom surface.

10. The footwear of claim 1, wherein the sole includes a bottom surface, and each pivot point of the at least one pivot point protrudes from the bottom surface of the sole.

11. The footwear of claim 10, wherein one pivot point of the at least one pivot point protrudes from the bottom surface of the sole by less than 0.5 mm.

12. The footwear of claim 1, wherein one pivot point of the at least one pivot point and the sole comprise different materials.

13. The footwear of claim 12, wherein each pivot point of the at least one pivot point is greater in hardness than the sole.

14. The footwear of claim 1, wherein the at least one pivot point includes a first pivot point and a second pivot point, and the first pivot point is disposed on the heel portion and the second pivot point is disposed on the forefoot portion.

15. The footwear of claim 14, wherein the first pivot point is configured to be located under a heel of the foot of a user when worn, and the second pivot point is configured to be located under a ball of a foot of a user.

16. The footwear of claim 1, wherein the footwear upper comprises a different material than either the sole or the pivot point.

* * * * *